US009008560B2

(12) United States Patent
Otsu

(10) Patent No.: US 9,008,560 B2
(45) Date of Patent: Apr. 14, 2015

(54) SLIDE MEMBER FOR FIXING DEVICE, FIXING DEVICE, AND IMAGE FORMING APPARATUS

(71) Applicant: Fuji Xerox Co., Ltd., Minato-ku, Tokyo (JP)

(72) Inventor: Shigemi Otsu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 95 days.

(21) Appl. No.: 13/767,278

(22) Filed: Feb. 14, 2013

(65) Prior Publication Data

US 2014/0086651 A1 Mar. 27, 2014

(30) Foreign Application Priority Data

Sep. 21, 2012 (JP) ..... 2012-208836

(51) Int. Cl.
*G03G 15/20* (2006.01)

(52) U.S. Cl.
CPC ..... *G03G 15/2075* (2013.01); *G03G 15/2053* (2013.01); *G03G 15/206* (2013.01); *G03G 15/2025* (2013.01); *G03G 2215/2025* (2013.01); *G03G 2215/2035* (2013.01)

(58) Field of Classification Search
CPC ..... G03G 15/206
USPC ..... 399/329
See application file for complete search history.

(56) References Cited

U.S. PATENT DOCUMENTS

| | | | | |
|---|---|---|---|---|
| 6,456,819 | B1 * | 9/2002 | Abe et al. | 399/329 |
| 7,917,073 | B2 * | 3/2011 | Miyata et al. | 399/329 |
| 8,195,072 | B2 * | 6/2012 | Okuno | 399/322 |
| 2011/0008083 | A1 * | 1/2011 | Okamoto | 399/329 |
| 2013/0216282 | A1 * | 8/2013 | Ohtsu | 399/329 |

FOREIGN PATENT DOCUMENTS

| | | | |
|---|---|---|---|
| JP | 2002-299007 | A | 10/2002 |
| JP | 2005-003969 | A | 1/2005 |
| JP | 2005173441 | A * | 6/2005 |
| JP | 2008-275755 | A | 11/2008 |

* cited by examiner

*Primary Examiner* — Clayton E Laballe
*Assistant Examiner* — Leon W Rhodes, Jr.
(74) *Attorney, Agent, or Firm* — Sughrue Mion, PLLC

(57) ABSTRACT

A slide member for a fixing device includes a fluororesin layer having a slide surface dotted with recesses. The recesses in the slide surface are arranged in an array having parallel hexagons as unit cells.

7 Claims, 6 Drawing Sheets

SLIDE MEMBER FOR FIXING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2012-208836 filed Sep. 21, 2012.

BACKGROUND

Technical Field

The present invention relates to slide members for fixing devices, fixing devices, and image forming apparatuses.

SUMMARY

According to an aspect of the invention, there is provided a slide member for a fixing device, the slide member including a fluororesin layer having a slide surface dotted with recesses. The recesses in the slide surface are arranged in an array having parallel hexagons as unit cells.

BRIEF DESCRIPTION OF THE DRAWINGS

Exemplary embodiments of the present invention will be described in detail based on the following figures, wherein.

DETAILED DESCRIPTION

Figure 1:
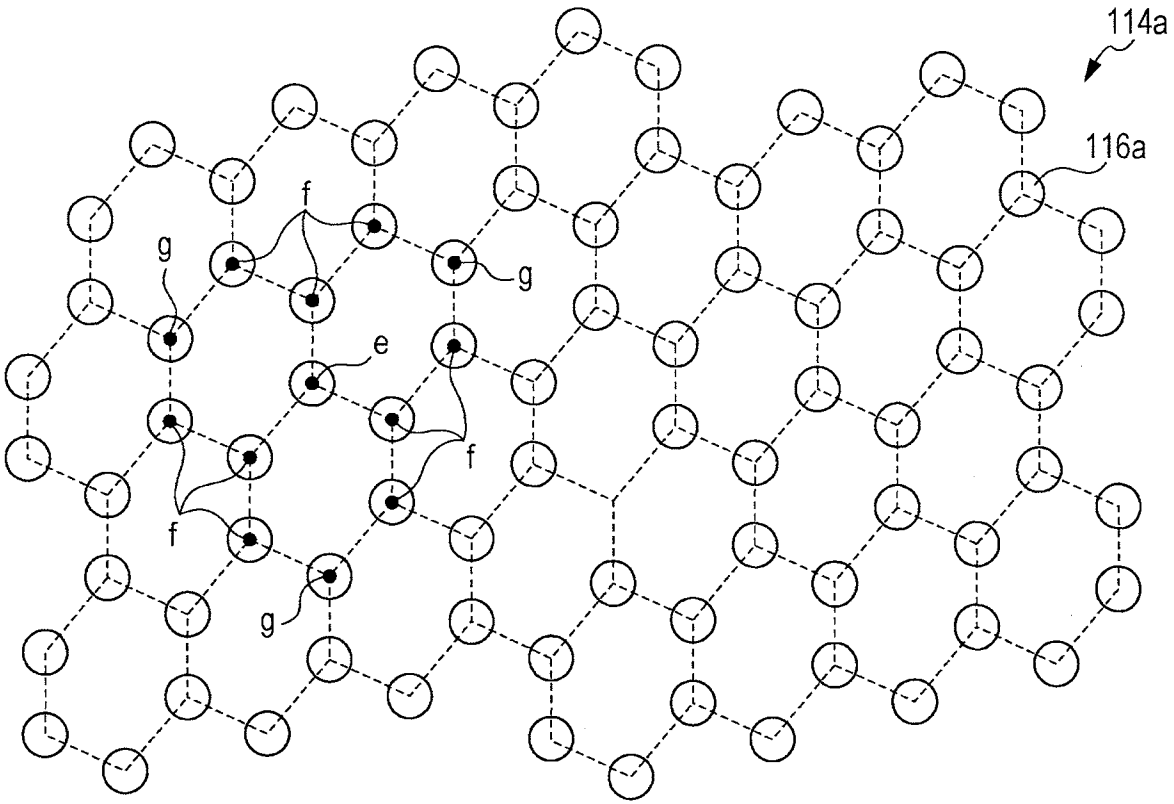
FIG. 1 is a schematic plan view illustrating a configuration example of a slide surface of a slide member for a fixing device according to an exemplary embodiment.

A slide member for a fixing device, a fixing device, and an image forming apparatus according to exemplary embodiments will be described below.

Slide Member for Fixing Device

A slide member for a fixing device (referred to as "slide member" hereinafter) according to an exemplary embodiment includes a fluororesin layer having a slide surface dotted with recesses. The recesses dotted over the slide surface are arranged in an array (referred to as "honeycomb array") having parallel hexagons as unit cells.

The slide member according to this exemplary embodiment is used as, for example, a slide member included in a fixing device in an electrophotographic image forming apparatus. In this fixing device, a slide surface of the slide member according to this exemplary embodiment is supplied with, for example, a lubricant (oil) for reducing the slide resistance between the slide member and a member against which the slide member is slid (referred to as "opposed slide member" hereinafter).

In the slide member according to this exemplary embodiment, the recesses dotted over the slide surface are arranged in a honeycomb array having parallel hexagons as unit cells so that the slide surface has high abrasion resistance. The reason for this is uncertain, but is assumed as follows.

In a belt-nip-type fixing device, for example, a belt is pressed against a roller by a pressing member from the inner peripheral surface of the belt, and a slide member is disposed between the belt and the pressing member so as to reduce the slide resistance when the belt rotates.

In the related art, a slide member having a slide surface dotted with recesses is known. The recesses of the slide member are provided for retaining a lubricant (oil) and supplying the lubricant (oil) to a contact region between the slide member and the opposed slide member, and also for reducing the area of the contact region to minimize a friction efficient. Known examples of the array pattern of the recesses in the slide surface include a lattice pattern and a centered lattice pattern. In this specification, the term "centered lattice pattern" refers to a structure in which a total of five points, that is, the apexes and the intersection point of diagonal lines of a square or a rectangle, serve as lattice points of a unit cell.

The slide member becomes gradually abraded by being repeatedly slid against the opposed slide member (i.e., belt). The abrasion of the slide member conceivably occurs more readily when the contact pressure thereof against the opposed slide member becomes uneven due to the slide member becoming distorted in shape as it is slid against the opposed slide member.

Because the recesses in the slide surface of the slide member according to this exemplary embodiment are arranged in the aforementioned honeycomb array, the slide member may less likely to become distorted as it is slid against the opposed slide member, thus reducing the occurrence of unevenness in contact pressure, as compared with a slide member in which the recesses are arranged in a lattice pattern or a centered lattice pattern. As a result, the slide surface may conceivably resist abrasion and thus have high abrasion resistance. Consequently, a longer lifespan of the slide member and the fixing device may be achieved.

Array Pattern of Recesses

In the slide member according to this exemplary embodiment, the recesses dotted over the slide surface are arranged in a honeycomb array having parallel hexagons as unit cells.

In other words, the recesses are located at lattice points of the honeycomb array having the parallel hexagons as unit cells, that is, at the apexes of the parallel hexagons. The recesses are not located within the parallel hexagons constituting the honeycomb array.

With regard to the recesses, the center points of the openings thereof may be located at the lattice points of the honeycomb array, that is, at the apexes of the parallel hexagons.

The honeycomb array is a structure in which the parallel hexagons are arranged across a plane. The parallel hexagons constituting the honeycomb array may be continuously arranged with no gaps therebetween in all directions, specifically, in a closest packed pattern. Alternatively, the parallel hexagons may be arranged in a discontinuous pattern or a deviated pattern.

The honeycomb array may be constituted of a single kind of parallel hexagons (including similar parallel hexagons) or two or more kinds of parallel hexagons. The single kind of parallel hexagons may include identical parallel hexagons or similar parallel hexagons.

The shape of the parallel hexagons serving as the unit cells of the honeycomb array is not limited and may be a regular hexagonal shape.

In particular, the honeycomb array may have a closest packed structure with identical regular hexagons.

By giving the honeycomb array the aforementioned structure, the slide member according to this exemplary embodiment may be resistant to lopsided abrasion of the slide surface.

Furthermore, by giving the honeycomb array the aforementioned structure, the slide member according to this exemplary embodiment may readily achieve lubricant (oil) retaining and supplying functions evenly over the entire slide surface, thereby readily reducing the slide resistance between the slide member and the opposed slide member.

In the slide member according to this exemplary embodiment, all of lines constituting the width of the slide surface may each be provided with at least one recess. The expression "lines may each be provided with at least one recess" includes a case where the recess is in contact with the line.

In other words, when a line extending parallel to the sliding direction is drawn at an arbitrary position on the slide surface in a direction orthogonal to the sliding direction, at least one recess may be provided on the line.

More specifically, when the slide surface is viewed in the sliding direction, at least one recess may be disposed across the overall width (in the direction orthogonal to the sliding direction) of the slide surface.

With the recesses disposed in the slide surface in this manner, when the slide member and the opposed slide member slide against each other, a slide surface of the opposed slide member has no regions that do not face the openings of the recesses. In other words, when the slide member and the opposed slide member slide against each other, the entire slide surface of the opposed slide member would face the openings of the recesses. Therefore, the lubricant (oil) is supplied to the entire slide surface from the recesses. As a result, the slide resistance between the slide member and the opposed slide member may be reduced over the entire slide surface (and the entire slide surface of the opposed slide member).

In order to provide each of the lines constituting the width of the slide surface with at least one recess in the slide member according to this exemplary embodiment, for example, the honeycomb array is formed so as to satisfy the following condition (1).

Condition (1) for the honeycomb array is as follows: when a group of nine lines are drawn from one arbitrary lattice point to a total of nine lattice points, which are located on three parallel hexagons including the aforementioned lattice point and are distant from the aforementioned lattice point by a distance equivalent to one or two sides of the parallel hexagons, none of the lines are aligned with the sliding direction.

Condition (1) may be the following condition (2).

Condition (2) for the honeycomb array is as follows: when a group of 12 lines are drawn from one arbitrary lattice point to a total of 12 lattice points, which exclude the aforementioned lattice point and are located on three parallel hexagons including the aforementioned lattice point, none of the lines are aligned with the sliding direction.

With the honeycomb array satisfying condition (2), the recesses are scattered about more randomly in the sliding direction, thereby reducing the occurrence of uneven lubricant (oil) retaining and supplying functions.

If the honeycomb array has regular hexagons as unit cells, conditions (1) and (2) described above are covered by the following condition (3).

Condition (3) for the honeycomb array is as follows: when a line that connects central points of two arbitrary adjacent regular hexagons is drawn, an angle formed between the line and the sliding direction is not equal to 0°, 30°, 60°, 90°, 120°, or 150°, but is an angle excluding these angles.

Because the length of the slide surface (i.e., the distance in the sliding direction) is limited, if the area of the opening of each recess is relatively small, a state in which each of the lines constituting the width of the slide surface is provided with at least one recess may be difficult to achieve even with conditions (1) to (3) described above. However, a state close to the aforementioned state may be achieved based on conditions (1) to (3) (in other words, the number of lines constituting the width of the slide surface and having no recesses provided thereon may be reduced). Therefore, by forming the honeycomb array by disposing the recesses in the slide surface such that any of conditions (1) to (3) is satisfied, the slide resistance between the slide member and the opposed slide member may be reduced over the entire slide surface (and the entire slide surface of the opposed slide member).

In a slide member in the related art having a slide surface dotted with recesses in a lattice pattern or a centered lattice pattern, the area of the opening of each recess is sometimes increased so as to enhance the function for supplying the lubricant (oil) from the slide member to the opposed slide member. This would increase the percentage at which the total area of the openings of the recesses occupies the slide surface and thus decrease the area of a flat portion of the slide surface, resulting in lower abrasion resistance. As a result, the lifespan of the slide member tends to become shorter.

In contrast, in the slide member according to this exemplary embodiment, the honeycomb array is formed by disposing the recesses in the slide surface such that any of conditions (1) to (3) is satisfied. Thus, the area of the opening of each recess is not increased, whereby the percentage at which the total area of the openings of the recesses occupies the slide surface does not have to be increased.

Consequently, in the slide member according to this exemplary embodiment, the lubricant (oil) supplying function may be enhanced, while the slide surface has high abrasion resistance. Therefore, with the slide member according to this exemplary embodiment, the slide resistance between the slide member and the opposed slide member may be reduced, while the slide surface has high abrasion resistance.

The period (i.e., array pitch) of the honeycomb array may range between 0.2 mm and 2.0 mm, or between 0.3 mm and 1.5 mm.

The period (i.e., array pitch) of the honeycomb array refers to a distance between central points of two arbitrary adjacent parallel hexagons that constitute the honeycomb array, and is one of the following.

(i) If the honeycomb array is constituted of regular hexagons as unit cells, there is one uniform distance between central points of two arbitrary adjacent regular hexagons constituting the honeycomb array, and this distance corresponds to the period (i.e., array pitch).

(ii) If the honeycomb array is constituted of parallel hexagons, other than regular hexagons, as unit cells, depending on the shape of the parallel hexagons, there are three or two distances between central points of two arbitrary adjacent parallel hexagons constituting the honeycomb array, and these distances correspond to the periods (i.e., array pitches).

In the case of (ii), the multiple periods (i.e., array pitches) may be within one of the aforementioned ranges.

With regard to each parallel hexagon as a unit cell of the honeycomb array, each side of the parallel hexagon may have a length ranging between 0.3 mm and 1.0 mm, or between 0.4 mm and 0.8 mm.

If the honeycomb array has regular hexagons as unit cells, the sides of each regular hexagon each have a length ranging between 0.3 mm and 1.0 mm, or between 0.4 mm and 0.8 mm.

Shape of Recesses

The shape of the recesses is not limited so long as the recesses have the lubricant (oil) retaining and supplying functions.

Examples of the shape in the planar direction include a circular shape, an elliptical shape, a triangular shape, a rectangular shape, other polygonal shapes, and an indefinite shape. A circular shape may be used for facilitating the process for forming the recesses in the slide surface.

Examples of the shape in the depth direction include a columnar shape, a conical shape, a tapered shape, and an inverse-tapered shape.

The area of the opening of each recess may range between $7\times10^{-3}$ mm$^2$ and 3.2 mm$^2$, or between 0.03 mm$^2$ and 0.8 mm$^2$.

In detail, if each recess has a circular shape in the planar direction, the diameter of the opening thereof may range between 100 μm and 2 mm, or between 150 μm and 1 mm.

In order to suppress the occurrence of uneven pressing while ensuring the lubricant (oil) retaining and supplying functions, the period of the honeycomb array may be set within one of the aforementioned ranges, and the area of the opening of each recess may be set within one of the aforementioned ranges.

In order to achieve high abrasion resistance for the slide surface while ensuring the lubricant (oil) retaining and supplying functions, the percentage at which the total area of the openings of the recesses occupies the slide surface may range between 10% and 60%, or between 15% and 40%.

On a surface of the slide member that comes into contact with the opposed slide member, ends of the slide member in the sliding direction and ends of the slide member in the width direction (i.e., the direction orthogonal to the sliding direction) may sometimes have regions that do not come into contact with the opposed slide member. In that case, the ends that do not come into contact with the opposed slide member do not correspond to the slide surface, and such ends do not have to be provided with recesses.

In the slide member, the slide surface may have the recesses in all of the lattice points of the honeycomb array. Alternatively, the slide surface may lack some of the recesses so long as the effect of this exemplary embodiment is not impaired.

Specific Configuration Example of Slide Surface

The configuration of the slide surface of the slide member according to this exemplary embodiment will be described below with reference to FIGS. 1 and 2.

Figure 2:
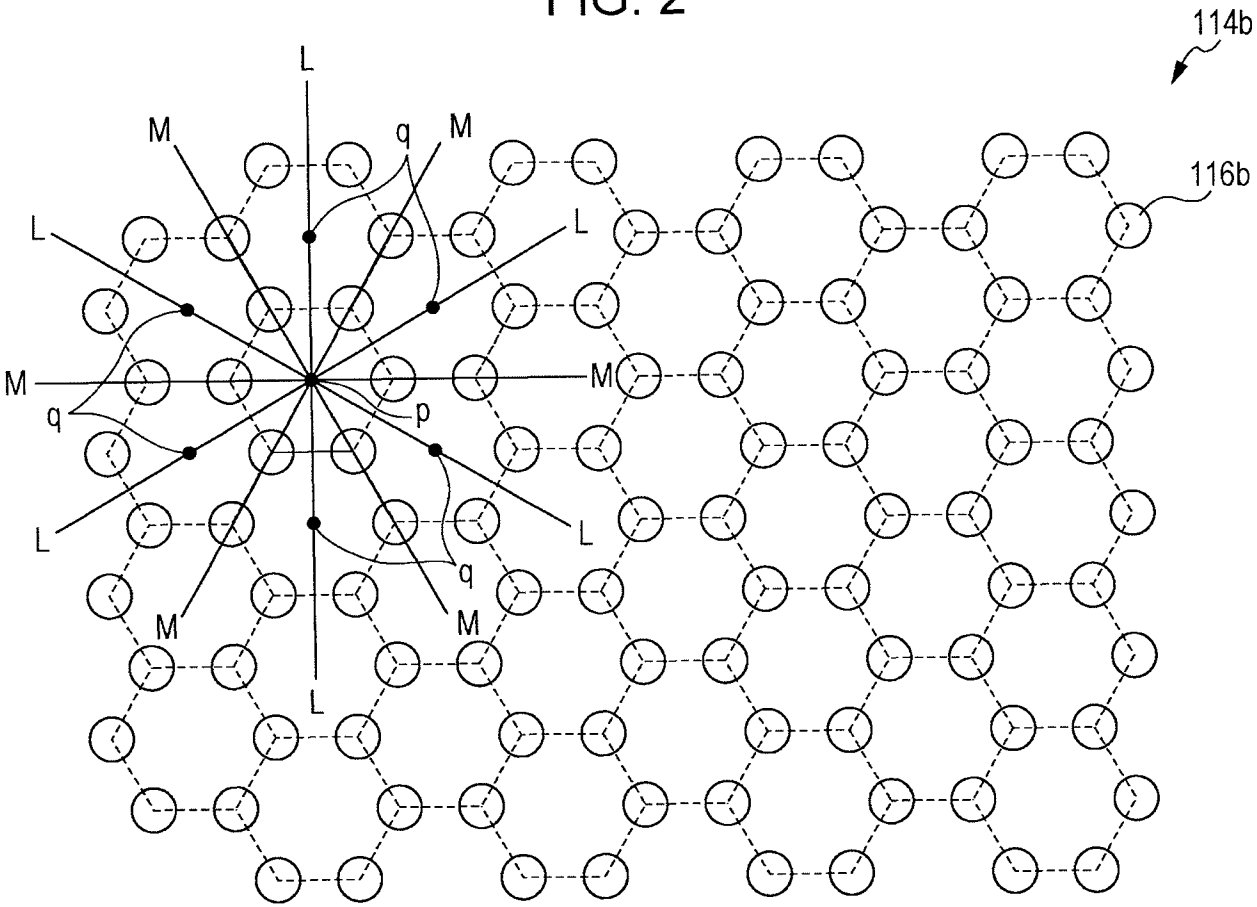
FIG. 2 is a schematic plan view illustrating another configuration example of the slide surface of the slide member for a fixing device according to the exemplary embodiment.

FIGS. 1 and 2 are schematic plan views of the slide surface, illustrating examples of array patterns of the recesses in the slide surface of the slide member according to this exemplary embodiment.

A slide surface 114*a* shown in FIG. 1 will now be described.

The slide surface 114*a* is dotted with recesses 116*a*. The recesses 116*a* have, for example, circular openings.

The recesses 116*a* are arranged in a honeycomb array having parallel hexagons as unit cells. This honeycomb array has a closest packed structure with identical parallel hexagons. The recesses 116*a* are located at the lattice points of the honeycomb array.

In the slide member, all of the lines constituting the width (in the direction orthogonal to the sliding direction) of the slide surface 114*a* may each be provided with at least one recess 116*a*.

In order to achieve this state, for example, the honeycomb array is formed such that condition (1) or (2) described above is satisfied.

With reference to FIG. 1, conditions (1) and (2) are the following conditions (1') and (2').

Condition (1') for the honeycomb array is as follows: when a group of nine lines are drawn from an arbitrarily-selected lattice point e to lattice points f that are distant from the lattice point e by a distance equivalent to one or two sides of parallel hexagons, none of the lines are aligned with the sliding direction.

Condition (2') for the honeycomb array is as follows: when a group of 12 lines are drawn from the arbitrarily-selected lattice point e to the lattice points f and lattice points g that constitute parallel hexagons together with the lattice point e, none of the lines are aligned with the sliding direction.

Next, a slide surface 114*b* shown in FIG. 2 will be described.

The slide surface 114*b* is dotted with recesses 116*b*. The recesses 116*b* have, for example, circular openings.

The recesses 116*b* are arranged in a honeycomb array having regular hexagons as unit cells. This honeycomb array has a closest packed structure with identical regular hexagons. The recesses 116*b* are located at the lattice points of the honeycomb array.

In the slide member, all of the lines constituting the width (in the direction orthogonal to the sliding direction) of the slide surface 114*b* may each be provided with at least one recess 116*b*.

In order to achieve this state, for example, the honeycomb array is formed such that condition (3) described above is satisfied.

With reference to FIG. 2, condition (3) is the following condition (3').

Condition (3') is as follows: when a line L that connects a central point p and a central point q of two arbitrarily-selected adjacent regular hexagons is drawn, an angle formed between the line L and the sliding direction is not equal to 0°, 30°, 60°, 90°, 120°, or 150°, but is an angle excluding these angles.

In other words, condition (3') is as follows: when six lines L (which result in three lines; the same applies hereinafter) that connect a central point p of an arbitrarily-selected regular hexagon to central points q of six regular hexagons adjacent to the aforementioned regular hexagon are drawn, and six lines M that form a 30° angle with the six lines L are drawn, lines that extend through the central point p and are parallel to the sliding direction do not overlap the lines L and the lines M.

Layer Configuration of Slide Member

A layer configuration of the slide member according to this exemplary embodiment will be described below with reference to FIGS. 3A to 3C.

Figure 3A:
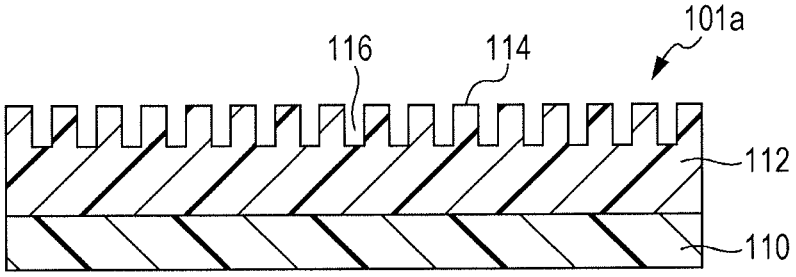
FIGS. 3A to 3C are schematic cross-sectional views illustrating layer configuration examples of the slide member for a fixing device according to this exemplary embodiment.
Figure 3B:
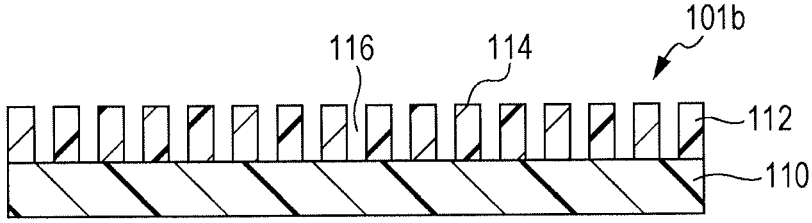
Figure 3C:
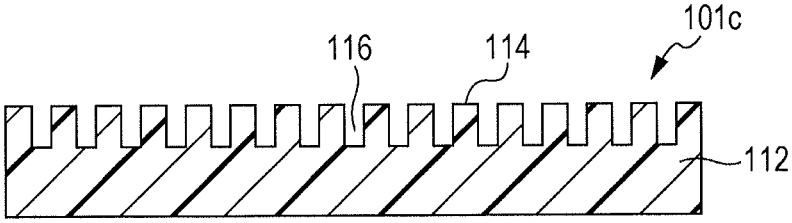

FIGS. 3A to 3C are schematic cross-sectional views illustrating layer configuration examples of the slide member according to this exemplary embodiment.

Slide members 101*a* and 101*b* shown in FIGS. 3A and 3B are each constituted of a sheet-shaped substrate 110 and a fluororesin layer 112 provided on the substrate 110. An adhesive layer for bonding the substrate 110 and the fluororesin layer 112 to each other is not shown.

A slide member 101*c* shown in FIG. 3C is constituted of a fluororesin layer 112 alone.

Each of the slide members 101*a* and 101*b* is a multilayer body constituted of the fluororesin layer 112 and the substrate 110. The fluororesin layer 112 is supported by the substrate 110 so that deformation of the fluororesin layer 112 is suppressed when the slide member slides against the opposed slide member.

The slide member 101*c* is a monolayer body constituted of the fluororesin layer 112. The fluororesin layer 112 has enough thickness for suppressing deformation of the fluororesin layer 112 when the slide member slides against the opposed slide member.

In each of the slide members 101*a* and 101*c*, recesses 116 are formed by providing the fluororesin layer 112 constituting a slide surface 114 with holes (i.e., recesses) that do not completely extend through the fluororesin layer 112 in the thickness direction thereof.

In the slide member 101*b*, the recesses 116 are formed by a surface of the substrate 110 and through-holes that completely extend through the fluororesin layer 112 in the thickness direction thereof.

Layers of Slide Member

The layers constituting each of the slide members 101*a*, 101*b*, and 101*c* shown in FIGS. 3A, 3B, and 3C will be described below in detail.

In the following description, the term "principal component" refers to a component with a mass ratio of 50% or higher.

Fluororesin Layer

The fluororesin layer 112 constitutes a slide surface. The fluororesin layer 112 contains fluororesin as a principal component, and may contain an additive, such as a filler, where appropriate.

Examples of resin used for forming the fluororesin layer 112 include polytetrafluoroethylene, perfluoroalkoxy alkane, and a copolymer of ethylene and tetrafluoroethylene.

Of the above examples, the fluororesin layer 112 may contain cross-linked fluororesin as a principal component in view of the durability of the slide member, and may particularly contain cross-linked polytetrafluoroethylene (referred to as "cross-linked PTFE" hereinafter).

An example of the cross-linked PTFE constituting the fluororesin layer 112 includes cross-linked PTFE obtained by irradiating non-cross-linked PTFE with ionizing radiation. In detail, cross-linked PTFE is obtained by, for example, irradiating non-cross-linked PTFE, which is heated to a higher temperature than a crystalline melting point, with ionizing radiation (e.g., a γ ray, an electron beam, an x ray, a neutron ray, or high-energy ions) ranging between 1 KGy and 10 MGy in a non-oxygen-existing environment.

PTFE may contain a copolymer component other than tetrafluoroethylene, such as perfluoro (alkyl vinyl ether), hexafluoropropylene, (perfluoro alkyl)ethylene, or chlorotrifluoroethylene.

The filler is an additive material for adding electrical conductivity and thermal conductivity, as well as for enhancing durability.

The filler may be selected from among at least one of metal oxide particles, silicate mineral, carbon black, and nitrogen compound.

Ketjen black, graphite, or acetylene black may be used for adding electrical conductivity. Graphite, copper, silver, aluminum nitride, boron nitride, or alumina may be used for adding thermal conductivity. The filler used may include a single kind of material or two or more kinds of materials.

The filler may have an average particle diameter ranging between 0.01 μm and 20 μm.

If the filler is to be used, the content thereof may range between 0.01 parts by mass and 30 parts by mass relative to 100 parts by mass of fluororesin.

The thickness of the fluororesin layer 112 is set in accordance with the shape of the layer, the rigidity of the layer, and the properties of the substrate 110. Normally, the thickness may range between 20 μm and 500 μm, or between 50 μm and 400 μm.

If the slide member according to this exemplary embodiment does not have the substrate 110 and is a monolayer body constituted of the fluororesin layer 112, the thickness of the fluororesin layer 112 may range between 200 μm and 400 μm in view of shape maintainability and durability.

Substrate

The substrate 110 is sheet-shaped and contains, for example, a resin material and an additive, such as a filler, where appropriate.

Examples of the resin material include polyimide resin, polyamide resin, polyamide-imide resin, polyether-ester resin, polyarylate resin, polyester resin, and polyester resin with a reinforcement material as an additive. Of the above examples, polyimide resin, which has high heat-resisting properties and high mechanical strength, may be used.

The thickness of the substrate 110 may range, for example, between 50 μm and 150 μm, or between 60 μm and 130 μm.

Adhesive Layer

An adhesive layer for bonding the substrate 110 and the fluororesin layer 112 to each other is provided therebetween.

The adhesive layer may be composed of a known adhesive, such as heat-resisting silicone resin or epoxy-based resin, or may be formed of an adhesive sheet.

In the case where the slide member according to this exemplary embodiment is provided with through-holes in the fluororesin layer 112, as in the slide member 101*b*, an adhesive sheet may be used rather than an adhesive so that the through-holes are prevented from being blocked. In that case, the adhesive sheet may have holes with the same shape as the through-holes in the fluororesin layer 112.

The thickness of the adhesive sheet may range between 10 μm and 30 μm.

The adhesive sheet may be of a type that brings forth heat fusion by being heated to a fusion point or higher so as to bond the substrate 110 and the fluororesin layer 112 to each other. Moreover, a fluorine-based adhesive sheet may be used since it does not react with the lubricant (oil), is not degraded by the lubricant (oil), and is less likely to induce degradation of the lubricant (oil). Specifically, "SILKY BOND" manufactured by Junkosha Inc. may be used.

Manufacturing Method of Slide Member

For example, the slide members 101*a* and 101*b* shown in FIGS. 3A and 3B are each manufactured by the following steps.

First, a sheet that is to become the substrate 110 and a fluororesin sheet that is to become the fluororesin layer 112 are prepared.

Then, based on the following method, recesses or through-holes are formed in the fluororesin sheet that is to become the fluororesin layer 112.

A method for forming recesses in the fluororesin sheet include, for example, preparing a die having protrusions on a pressing surface thereof that is to be pressed onto the fluororesin sheet, pressing the die onto the fluororesin sheet (e.g., a cross-linked PTFE sheet), and heating the fluororesin sheet to a glass transition temperature thereof or higher so that recesses that correspond to the protrusions are formed.

The protrusions on the pressing surface of the die may be formed by using a numerically-controlled (NC) machine tool or by etching.

Alternatively, the protrusions may be formed by nickel electroforming or by a combination of nickel electroforming and photolithography. These techniques may be used for higher accuracy and easier duplication.

Examples of methods for forming through-holes in the fluororesin sheet include laser processing (by using a $CO_2$ laser, an excimer laser, etc.), drilling, and punching by using a die.

If the hole diameter is relatively large (e.g., larger than 0.3 mm), a punching process using a die is suitable. If the hole diameter is relatively small (e.g., smaller than 0.5 mm), laser processing is suitable.

Subsequently, the sheet that is to become the substrate 110 and the fluororesin sheet having the recesses or the through-holes formed therein are bonded to each other by using, for example, a fluorine-based adhesive sheet. This bonding process is performed by forming a multilayer body constituted of three sheets (i.e., the sheet that is to become the substrate 110, the fluorine-based adhesive sheet, and the fluororesin sheet having the recesses or the through-holes formed therein), and then applying heat and pressure to the multilayer body from above and below.

The pressure applied to the multilayer body during this bonding process ranges between, for example, 1.0 MPa and 2.0 MPa, and the heating temperature ranges between, for example, 320° C. and 350° C.

The sheet that is to become the substrate 110 and the fluororesin sheet that is to become the fluororesin layer 112 may be bonded to each other before forming the recesses or through-holes in the fluororesin sheet. In this case, after forming a multilayer body constituted of the two sheets, for example, the die having protrusions on the pressing surface thereof is pressed onto the fluororesin sheet, and the fluororesin sheet is heated and pressed, thereby forming the recesses.

The slide member 101*c* shown in FIG. 3C is manufactured by, for example, pressing the die having protrusions on the pressing surface thereof onto the fluororesin sheet that is to become the fluororesin layer 112, and then heating the fluororesin sheet to the glass transition temperature thereof or higher so that recesses that correspond to the protrusions are formed.

Fixing Device

A fixing device according to an exemplary embodiment includes a first rotating body, a second rotating body disposed in contact with an outer surface of the first rotating body, a pressing member that is disposed within the second rotating body and presses the second rotating body toward the first rotating body from an inner surface of the second rotating body, and the slide member according to this exemplary embodiment disposed between the inner surface of the second rotating body and the pressing member.

The fixing device according to this exemplary embodiment may further include a heating source that heats at least one of the first rotating body and the second rotating body.

An inner surface (i.e., inner peripheral surface) of a heating belt or a pressure belt as an example of the second rotating body may have a surface roughness Ra ranging between 0.1 μm and 2.0 μm, or between 0.3 μm and 1.5 μm. With the aforementioned ranges, the slide resistance between the slide member and the heating belt or the pressure belt as an example of the second rotating body is reduced. Moreover, when the lubricant (oil) is interposed therebetween, the lubricant (oil) is readily retained between the two components, thereby improving the abrasion resistance of the slide member.

The surface roughness Ra is measured by using a surface-roughness measuring device "SURFCOM 1400A" (manufactured by Tokyo Seimitsu Co., Ltd.) in compliance with JIS B0601-1994 in a condition in which an evaluation length Ln is 4 mm, a reference length L is 0.8 mm, and a cutoff value is 0.8 mm.

Although there are various kinds of configurations for the fixing device according to this exemplary embodiment, the following two exemplary embodiments will be described in detail.

As a first exemplary embodiment, a fixing device including a heating roller having a heating source and a pressure belt pressed by a pressing pad will be described.

As a second exemplary embodiment, a fixing device including a heating belt, which has a heating source and is pressed by a pressing pad, and a pressure roller will be described.

The slide member according to this exemplary embodiment is used as a sheet-shaped slide member in each of these fixing devices.

Fixing Device According to First Exemplary Embodiment

A fixing device 60 according to the first exemplary embodiment will now be described with reference to FIG. 4.

Figure 4:
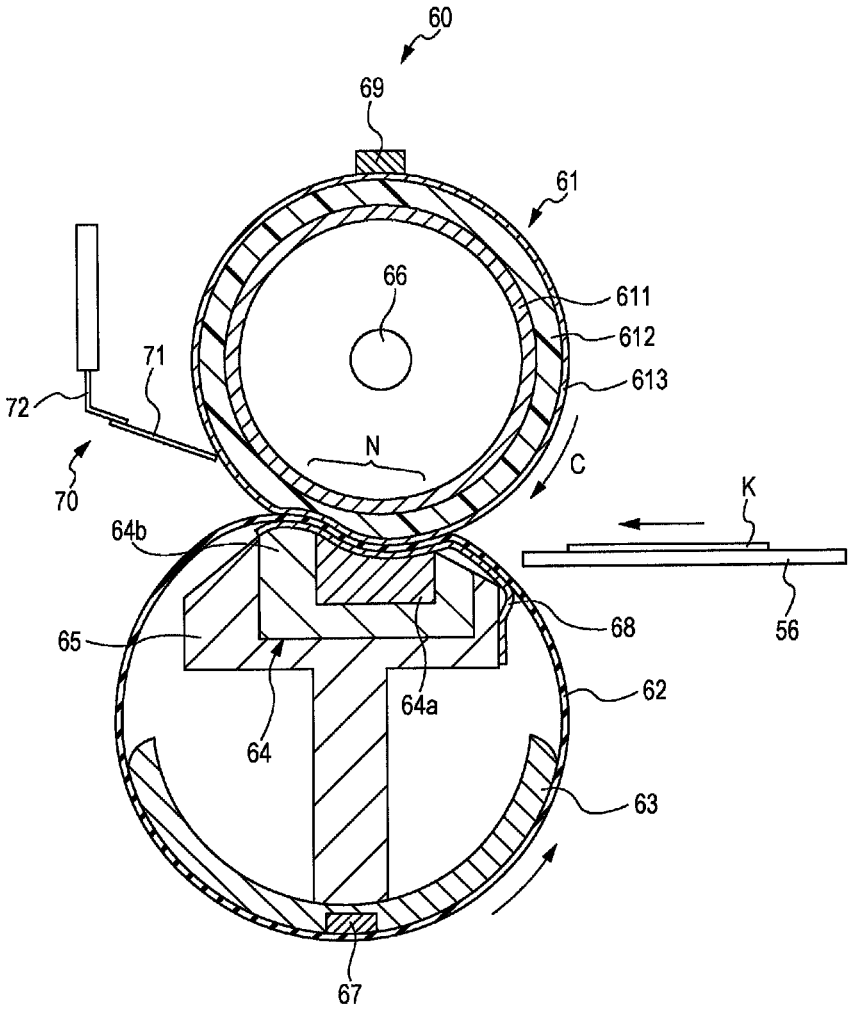
FIG. 4 schematically illustrates a configuration example of a fixing device according to a first exemplary embodiment.

FIG. 4 schematically illustrates the configuration of the fixing device 60 according to the first exemplary embodiment.

The fixing device 60 includes a heating roller 61 (as an example of the first rotating body), a pressure belt 62 (as an example of the second rotating body), a pressing pad 64 (as an example of the pressing member), a slide member 68 (as an example of the slide member according to this exemplary embodiment), and a halogen lamp 66 (as an example of the heating source).

The outer peripheral surface of the heating roller 61 and the outer peripheral surface of the pressure belt 62 are in contact with and apply and receive pressure to and from each other. The pressure belt 62 may press against the heating roller 61, or the heating roller 61 may press against the pressure belt 62. A nip region N is formed where the heating roller 61 and the pressure belt 62 are in contact with each other.

The heating roller 61 includes the halogen lamp 66 (as an example of the heating source) therein. The heating source is not limited to a halogen lamp and may alternatively be other heating components that generate heat.

A temperature sensor 69 is disposed in contact with the outer peripheral surface of the heating roller 61. Based on a temperature value measured by the temperature sensor 69, the halogen lamp 66 is on-off controlled so that the surface temperature of the heating roller 61 is maintained at a preset temperature (e.g., 150° C.).

The heating roller 61 is formed by, for example, stacking a heat-resisting elastic layer 612 and a release layer 613 in that order around a metallic core (cylindrical cored bar) 611.

The pressure belt 62 is disposed in contact with the outer peripheral surface of the heating roller 61.

The pressure belt 62 is rotatably supported by the pressing pad 64 and a belt guide 63 that are disposed within the pressure belt 62.

The pressing pad 64 is disposed within the pressure belt 62 and applies and receives pressure to and from the heating roller 61 via the pressure belt 62.

The pressing pad 64 includes a front nipping member 64*a* at the entrance side of the nip region N and a detachment nipping member 64*b* at the exit side of the nip region N.

The front nipping member 64*a* has a recessed shape that conforms to the outer peripheral shape of the heating roller 61 and ensures the length of the nip region N (i.e., the distance thereof in the sliding direction).

The detachment nipping member 64*b* has a shape that protrudes toward the outer peripheral surface of the heating roller 61 and causes the heating roller 61 to be locally distorted in an exit area of the nip region N so as to facilitate detachment of a recording medium from the heating roller 61 after a fixing process.

The slide member 68 is sheet-shaped and is disposed between the pressure belt 62 and the pressing pad 64 such that a slide surface (dotted with recesses) of the slide member 68 is in contact with the inner peripheral surface of the pressure belt 62.

The slide member 68 is responsible for the retainment and supply of the lubricant (oil) interposed between the slide surface and the inner peripheral surface of the pressure belt 62. The slide member 68 has high abrasion resistance so that a long lifespan of the fixing device 60 is achieved.

In order to reduce the slide resistance between the inner peripheral surface of the pressure belt 62 and the pressing pad 64, the slide member 68 is disposed so as to cover the front nipping member 64*a* and the detachment nipping member 64*b*.

A support member 65 supports the pressing pad 64 and the slide member 68. The support member 65 is composed of, for example, metal.

The belt guide 63 is attached to the support member 65. The pressure belt 62 rotates along the belt guide 63.

A lubricant feeder 67 as a unit that feeds the lubricant (oil) to the inner peripheral surface of the pressure belt 62 may be attached to the belt guide 63.

A detachment member 70 as a recording-medium detachment assisting unit is provided downstream of the nip region N. The detachment member 70 includes a detachment claw 71 and a supporter 72 that supports the detachment claw 71. The detachment claw 71 is disposed near the heating roller 61 and extends in a direction (i.e., counter direction) opposed to the rotational direction of the heating roller 61.

The heating roller 61 is rotated in a direction indicated by an arrow C by a driving motor (not shown), and the pressure belt 62 driven by this rotation rotates in a direction opposite to the rotational direction of the heating roller 61.

A sheet K (i.e., recording medium) having an unfixed toner image thereon is transported to the nip region N by being guided by a fixation entrance guide 56. As the sheet K travels through the nip region N, the toner image on the sheet K is fixed thereon by pressure and heat applied to the nip region N.

Fixing Device According to Second Exemplary Embodiment

A fixing device 80 according to the second exemplary embodiment will now be described with reference to FIG. 5.

Figure 5:
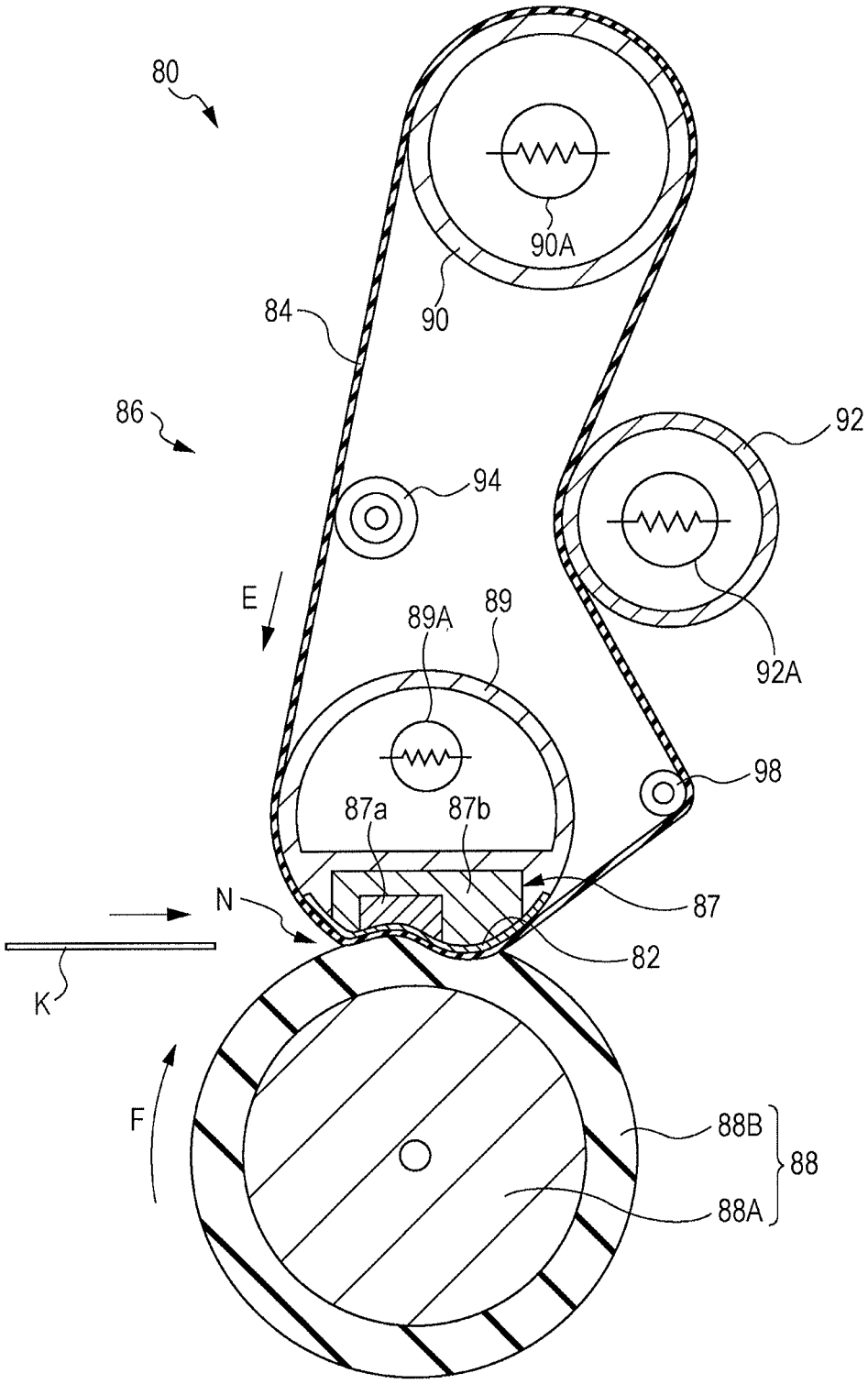
FIG. 5 schematically illustrates a configuration example of a fixing device according to a second exemplary embodiment.

FIG. 5 schematically illustrates the fixing device 80 according to the second exemplary embodiment.

The fixing device 80 includes a pressure roller 88 (as an example of the first rotating body) and a fixing belt module 86.

The fixing belt module 86 includes a heating belt 84 (as an example of the second rotating body), a pressing pad 87 (as an example of the pressing member), a slide member 82 (as an example of the slide member according to this exemplary embodiment), and a halogen heater 89A (as an example of at heating source) disposed near the pressing pad 87.

The fixing belt module 86 further includes a support roller 90, a support roller 92, an orientation correcting roller 94, and a support roller 98.

The pressure roller 88 is pressed against the heating belt 84 (i.e., the fixing belt module 86) so that the nip region N is formed where the pressure roller 88 and the heating belt 84 (i.e., the fixing belt module 86) are in contact with each other.

The heating belt 84 is an endless belt rotatably supported by the pressing pad 87 and the support roller 90 that are disposed within the heating belt 84.

The pressing pad 87 has the heating belt 84 wound therearound and presses the heating belt 84 toward the pressure roller 88.

The pressing pad 87 includes a front nipping member 87*a* and a detachment nipping member 87*b* and is supported by a support member 89.

The front nipping member 87*a* has a recessed shape that conforms to the outer peripheral shape of the pressure roller 88. The front nipping member 87*a* is disposed at the entrance side of the nip region N and ensures the length of the nip region N (i.e., the distance thereof in the sliding direction).

The detachment nipping member 87*b* has a shape that protrudes toward the outer peripheral surface of the pressure roller 88. The detachment nipping member 87*b* is disposed at the exit side of the nip region N and causes the pressure roller 88 to be locally distorted in an exit area of the nip region N so as to facilitate detachment of a recording medium from the pressure roller 88 after a fixing process.

The pressing pad 87 includes the halogen heater 89A (as an example of a heating source) in the vicinity thereof (e.g., inside the support member 89) and heats the heating belt 84 from the inner peripheral surface thereof.

For example, a lubricant feeder (not shown) as a unit that feeds the lubricant (oil) to the inner peripheral surface of the heating belt 84 may be attached to the support member 89 at the upstream side of the front nipping member 87*a*.

The slide member 82 is sheet-shaped and is disposed between the heating belt 84 and the pressing pad 87 such that a slide surface (dotted with recesses) of the slide member 82 is in contact with the inner peripheral surface of the heating belt 84.

The slide member 82 is responsible for the retainment and supply of the lubricant (oil) interposed between the slide surface and the inner peripheral surface of the heating belt 84. The slide member 82 has high abrasion resistance so that a long lifespan of the fixing device 80 is achieved.

The support roller 90 has the heating belt 84 wound therearound and supports the heating belt 84 at a position different from that of the pressing pad 87.

The support roller 90 includes a halogen heater 90A (as an example of at heating source) therein and heats the heating belt 84 from the inner peripheral surface thereof.

The support roller 90 is formed by, for example, forming a fluororesin release layer having a thickness of 20 μm around the outer peripheral surface of an aluminum cylindrical roller.

The support roller 92 is disposed in contact with the outer peripheral surface of the heating belt 84 between the pressing pad 87 and the support roller 90 and regulates a rotation path of the heating belt 84.

The support roller 92 includes a halogen heater 92A (as an example of at heating source) therein and heats the heating belt 84 from the outer peripheral surface thereof.

The support roller 92 is formed by, for example, forming a fluororesin release layer having a thickness of 20 μm around the outer peripheral surface of an aluminum cylindrical roller.

At least one of the halogen heater 89A, the halogen heater 90A, and the halogen heater 92A as examples of heating sources may be provided.

The orientation correcting roller 94 is disposed in contact with the inner peripheral surface of the heating belt 84 between the support roller 90 and the pressing pad 87 and corrects the orientation of the heating belt 84 between the support roller 90 and the pressing pad 87.

An edge-position measuring mechanism (not shown) that measures the edge position of the heating belt 84 is disposed in the vicinity of the orientation correcting roller 94. The orientation correcting roller 94 is provided with an axially shifting mechanism (not shown) that shifts the abutment position of the heating belt 84 in the axial direction thereof in accordance with a measurement result of the edge-position measuring mechanism. These mechanisms correct the orientation of the heating belt 84.

The orientation correcting roller 94 is, for example, an aluminum cylindrical roller.

The support roller 98 is disposed in contact with the inner peripheral surface of the heating belt 84 between the pressing pad 87 and the support roller 92 and applies tension to the heating belt 84 from the inner peripheral surface of the heating belt 84 at the downstream side of the nip region N.

The support roller 98 is formed by, for example, forming a fluororesin release layer having a thickness of 20 μm around the outer peripheral surface of an aluminum cylindrical roller.

The pressure roller 88 is pressed against the heating belt 84 in an area where the heating belt 84 is wound around the pressing pad 87.

The pressure roller 88 is rotatable and is driven by the heating belt 84 as the heating belt 84 rotates in a direction indicated by an arrow E, thereby rotating in a direction indicated by an arrow F.

The pressure roller 88 is formed by, for example, stacking a silicone-rubber elastic layer 88B and a fluororesin detachment layer (not shown) having a thickness of 100 μm in that order around the outer peripheral surface of an aluminum cylindrical roller 88A.

For example, the support roller 90 and the support roller 92 are rotated by a driving motor (not shown). The heating belt 84 driven by this rotation rotates in the direction of the arrow E. The pressure roller 88 driven by the rotation of the heating belt 84 rotates in the direction of the arrow F.

A sheet K (i.e., recording medium) having an unfixed toner image thereon is transported to the nip region N of the fixing device 80. Then, as the sheet K travels through the nip region N, the toner image on the sheet K is fixed thereon by pressure and heat applied to the nip region N.

Image Forming Apparatus

An image forming apparatus according to an exemplary embodiment includes an image bearing body, a charging device that electrostatically charges the surface of the image bearing body, a latent-image forming device that forms a latent image on the electrostatically-charged surface of the image bearing body, a developing device that forms a toner image by developing the latent image by using toner, a transfer device that transfers the toner image onto a recording medium, and the fixing device according to this exemplary embodiment that fixes the toner image onto the recording medium.

An electrophotographic image forming apparatus will be described below as an example of the image forming apparatus according to this exemplary embodiment. The image forming apparatus according to this exemplary embodiment is not limited to an electrophotographic image forming apparatus and may be known image forming apparatuses other than the electrophotographic type (such as an inkjet recording apparatus equipped with an endless belt for sheet transportation).

The image forming apparatus according to this exemplary embodiment will now be described with reference to FIG. 6.

Figure 6:
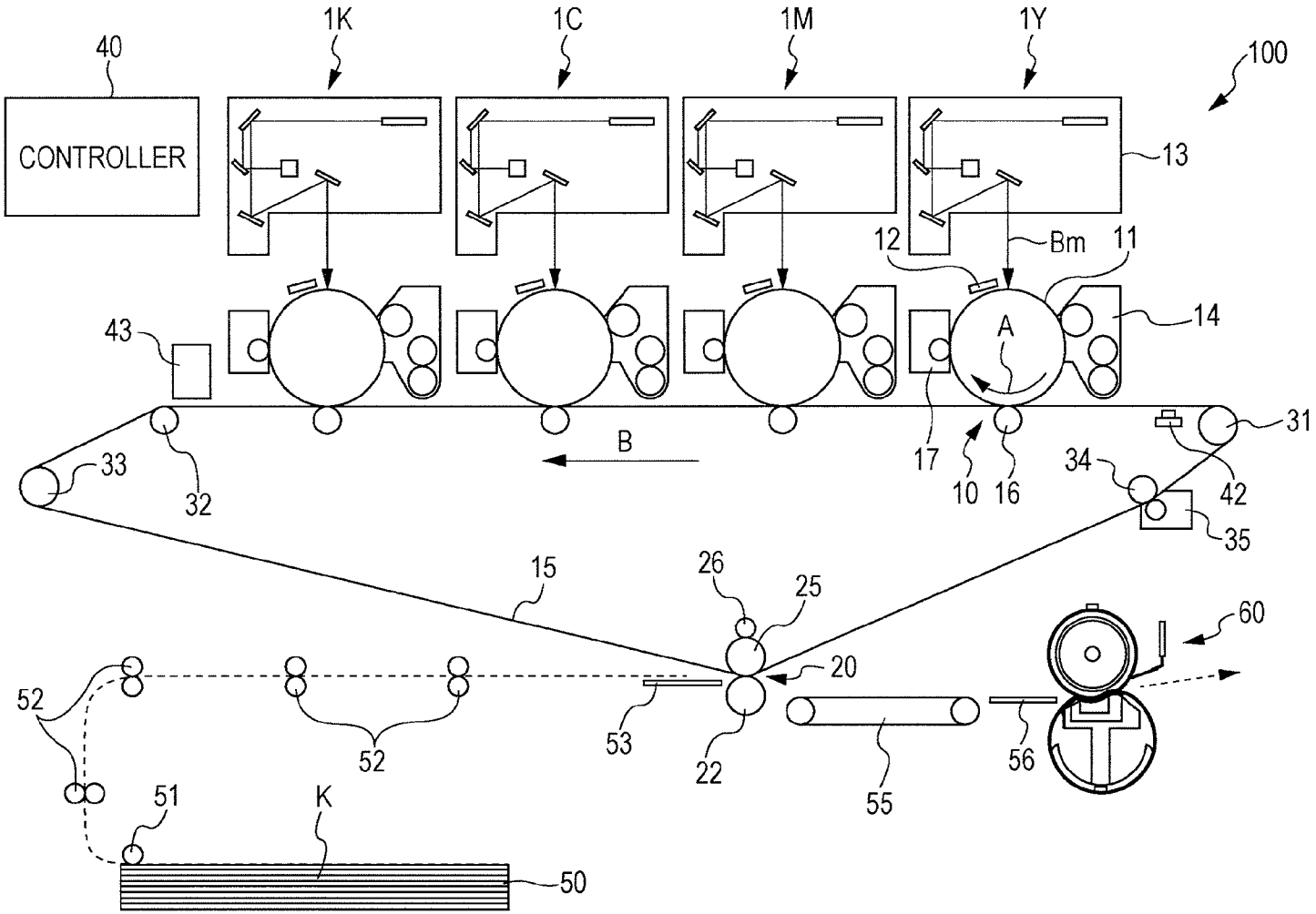
FIG. 6 schematically illustrates a configuration example of an image forming apparatus according to an exemplary embodiment.

FIG. 6 schematically illustrates the configuration of an image forming apparatus 100 according to this exemplary embodiment. The image forming apparatus 100 includes the fixing device 60 according to the first exemplary embodiment described above. The image forming apparatus 100 may alternatively include the fixing device 80 according to the second exemplary embodiment described above in place of the fixing device 60.

The image forming apparatus 100 is a so-called tandem-type intermediate-transfer image forming apparatus. The image forming apparatus 100 includes image forming units 1Y, 1M, 1C, and 1K that form toner images of respective colors by electrophotography, a first transfer section 10 that sequentially transfers (first-transfers) the toner images onto an intermediate transfer belt 15, a second transfer section 20 that collectively transfers (second-transfers) the superposed toner images transferred on the intermediate transfer belt 15 onto a sheet K as a recording medium, the fixing device 60 that fixes the second-transferred images onto the sheet K, and a controller 40 that controls the operation of each device (i.e., each section).

The image forming units 1Y, 1M, 1C, and 1K are arranged substantially linearly from the upstream side of the intermediate transfer belt 15 in the following order: the image forming unit 1Y for a yellow image, the image forming unit 1M for a magenta image, the image forming unit 1C for a cyan image, and the image forming unit 1K for a black image.

The image forming units 1Y, 1M, 1C, and 1K each include a photoconductor 11 (as an example of the image bearing body). The photoconductor 11 rotates in a direction indicated by an arrow A.

The photoconductor 11 is surrounded by a charging unit 12 (as an example of the charging device), a laser exposure unit 13 (as an example of the latent-image forming device), a developing unit 14 (as an example of the developing device), a first transfer roller 16, and a photoconductor cleaner 17 in that order in the rotational direction of the photoconductor 11.

The charging unit 12 electrostatically charges the surface of the photoconductor 11.

The laser exposure unit 13 forms an electrostatic latent image on the photoconductor 11 by emitting an exposure beam Bm thereto.

The developing unit 14 accommodates therein a toner of the corresponding color and develops the electrostatic latent image on the photoconductor 11 into a visible image by using the toner.

The first transfer roller 16 transfers the toner image formed on the photoconductor 11 onto the intermediate transfer belt 15 at the first transfer section 10.

The photoconductor cleaner 17 removes residual toner from the photoconductor 11.

The intermediate transfer belt 15 is composed of a material obtained by adding an antistatic agent, such as carbon black, to polyimide or polyamide resin. The intermediate transfer belt 15 has a volume resistivity ranging between, for example, $10^6$ Ωcm and $10^{14}$ Ωcm, and a thickness of, for example, 0.1 mm.

The intermediate transfer belt 15 is supported by a driving roller 31, a support roller 32, a tension applying roller 33, a back-surface roller 25, and a cleaning back-surface roller 34, and is rotationally driven (rotated) in a direction indicated by an arrow B by rotation of the driving roller 31.

The driving roller 31 is driven by a motor (not shown) having excellent constant-speed properties so as to rotate the intermediate transfer belt 15.

The support roller 32 supports the intermediate transfer belt 15, which extends substantially linearly in the arranged direction of the four photoconductors 11, together with the driving roller 31.

The tension applying roller 33 applies fixed tension to the intermediate transfer belt 15 and also functions as a correcting roller that suppresses meandering of the intermediate transfer belt 15.

The back-surface roller 25 is provided in the second transfer section 20. The cleaning back-surface roller 34 is provided in a cleaning section that scrapes off residual toner from the intermediate transfer belt 15.

The first transfer rollers 16 are disposed in pressure contact with the photoconductors 11 with the intermediate transfer belt 15 interposed therebetween, thereby forming the first transfer section 10.

The first transfer rollers 16 receive a voltage (i.e., first transfer bias) with a reversed polarity relative to the charge polarity of the toners (which is a negative polarity; the same applies hereinafter). Thus, the toner images on the photoconductors 11 are sequentially electrostatically attracted toward the intermediate transfer belt 15, whereby superposed toner images are formed on the intermediate transfer belt 15.

Each first transfer roller 16 is a cylindrical roller constituted of a shaft (i.e., a columnar rod composed of metal, such as iron or steel use stainless (SUS)), and an elastic layer (e.g., a sponge layer containing a blend of rubber and an electrically conductive agent, such as carbon black) fixedly attached around the shaft. Each first transfer roller 16 has a volume resistivity ranging between, for example, $10^{7.5}$ Ωcm and $10^{8.5}$ Ωcm.

A second transfer roller 22 is disposed in pressure contact with the back-surface roller 25 with the intermediate transfer belt 15 interposed therebetween, thereby forming the second transfer section 20.

By generating a second transfer bias between the second transfer roller 22 and the back-surface roller 25, the second transfer roller 22 second-transfers the toner images onto the sheet K (i.e., recording medium) transported to the second transfer section 20.

The second transfer roller 22 is a cylindrical roller constituted of a shaft (i.e., a columnar rod composed of metal, such as iron or steel use stainless (SUS)), and an elastic layer (e.g., a sponge layer containing a blend of rubber and an electrically conductive agent, such as carbon black) fixedly attached around the shaft. The second transfer roller 22 has a volume resistivity ranging between, for example, $10^{7.5}$ Ωcm and $10^{8.5}$ Ωcm.

The back-surface roller 25 is disposed at the back surface of the intermediate transfer belt 15 and serves as a counter-electrode for the second transfer roller 22 so that a transfer electric field is generated between the back-surface roller 25 and the second transfer roller 22.

The back-surface roller 25 is formed by, for example, coating a rubber base material with a tube containing a blend of rubber and carbon distributed therein. The back-surface roller 25 has a surface resistivity ranging between, for example, $10^7$ Ω/sq. and $10^{10}$ Ω/sq. and a hardness of, for example, 70° (measured using "ASKER C" manufactured by Kobunshi Keiki Co., Ltd.; the same applies hereinafter).

The back-surface roller 25 is disposed in contact with a power feeding roller 26 composed of metal. The power feeding roller 26 applies a voltage (i.e., second transfer bias) with the same polarity as the charge polarity of the toners (which is a negative polarity) so as to generate a transfer electric field between the second transfer roller 22 and the back-surface roller 25.

An intermediate-transfer-belt cleaner 35 for the intermediate transfer belt 15 is provided downstream of the second transfer section 20 in a movable manner toward and away from the intermediate transfer belt 15. The intermediate-transfer-belt cleaner 35 removes residual toner and paper particles from the intermediate transfer belt 15 after the second transfer process.

A reference sensor (i.e., home-position sensor) 42 is disposed upstream of the image forming unit 1Y. The reference sensor 42 generates a reference signal to be used as a reference for determining an image forming timing in the image forming units. The reference sensor 42 generates the reference signal by detecting a mark provided at the back surface of the intermediate transfer belt 15. Based on a command from the controller 40 having recognized this reference signal, the image forming units 1Y, 1M, 1C, and 1K commence an image forming process.

An image density sensor 43 for performing image quality adjustment is disposed downstream of the image forming unit 1K.

As a transport unit for transporting a sheet K, the image forming apparatus 100 includes a sheet accommodation section 50, a feed roller 51, a transport roller 52, a transport guide 53, a transport belt 55, and a fixation entrance guide 56.

The sheet accommodation section 50 accommodates sheets K that have not undergone an image forming process yet.

The feed roller 51 feeds each sheet K accommodated in the sheet accommodation section 50.

The transport roller 52 transports the sheet K fed by the feed roller 51.

The transport guide 53 delivers the sheet K transported by the transport roller 52 to the second transfer section 20.

The transport belt 55 transports the sheet K having an image transferred thereto by the second transfer section 20 to the fixing device 60.

The fixation entrance guide 56 guides the sheet K to the fixing device 60.

Next, an image forming method by the image forming apparatus 100 will be described.

In the image forming apparatus 100, image data output from an image reading device (not shown), a computer (not shown), or the like is image-processed by an image processing device (not shown), and an image forming process is performed by the image forming units 1Y, 1M, 1C, and 1K.

The image processing device performs image processing, such as shading correction, misregistration correction, brightness/color-space conversion, gamma correction, margin deletion, color editing, displacement editing, on input reflectance data. The image-processed image data is converted to colorant gradation data for the Y, M, C, and K colors and is output to the laser exposure units 13.

The laser exposure units 13 radiate exposure beams Bm to the photoconductors 11 in the image forming units 1Y, 1M, 1C, and 1K in accordance with the input colorant gradation data.

The surfaces of the photoconductors 11 in the image forming units 1Y, 1M, 1C, and 1K are electrostatically charged by the charging units 12 and subsequently undergo a scan exposure process by the laser exposure units 13, whereby electrostatic latent images are formed on the photoconductors 11. The electrostatic latent images formed on the photoconductors 11 are developed into toner images of the respective colors by the image forming units.

The toner images formed on the photoconductors 11 in the image forming units 1Y, 1M, 1C, and 1K are transferred onto the intermediate transfer belt 15 at the first transfer section 10 where the photoconductors 11 and the intermediate transfer belt 15 come into contact with each other. In the first transfer section 10, the first transfer rollers 16 apply a voltage (i.e., first transfer bias) with a reversed polarity relative to the charge polarity of the toners (which is a negative polarity) to the intermediate transfer belt 15 so that the toner images are sequentially superposed and transferred onto the intermediate transfer belt 15.

Due to the movement of the intermediate transfer belt 15, the toner images first-transferred on the intermediate transfer belt 15 are transported to the second transfer section 20.

In accordance with a timing at which the toner images reach the second transfer section 20, a sheet K accommodated in the sheet accommodation section 50 is supplied to the second transfer section 20 by being transported by the feed roller 51, the transport roller 52, and the transport guide 53, so as to become nipped between the intermediate transfer belt 15 and the second transfer roller 22.

Then, in the second transfer section 20 where a transfer electric field is generated, the toner images on the intermediate transfer belt 15 are electrostatically transferred (second-transferred) onto the sheet K.

The sheet K having the toner images electrostatically transferred thereon is detached from the intermediate transfer belt 15 by the second transfer roller 22 and is transported to the fixing device 60 by the transport belt 55.

The sheet K transported to the fixing device 60 is heated and pressed by the fixing device 60 so that the unfixed toner images become fixed onto the sheet K.

As a result of the above-described steps, an image is formed on the recording medium by the image forming apparatus 100.

EXAMPLES

Although the above exemplary embodiments will be described in detail with reference to examples, the exemplary embodiments are not to be limited to the examples to be described below.

First Comparative Example

An (80 mm by 400 mm) laminated sheet ("HGF-500-6" manufactured by Chukoh Chemical Industries, Ltd.) constituted of glass cloth and a 0.025-mm thick PTFE sheet is prepared. The surface of this sheet has protrusions and recesses that correspond to protrusions and recesses in the glass cloth.

Second Comparative Example

Preparation of Die

A rectangular (50 mm by 400 mm) stainless mesh sheet (30 mesh with a wire diameter of 0.22 mm) is prepared as a die. The columns and rows of the stainless wires constituting the mesh sheet respectively correspond to the lengthwise and widthwise directions of the rectangle.

Formation of Recesses

An (80 mm by 400 mm) multilayer sheet formed by bonding a 75-μm thick polyimide resin sheet serving as a substrate to a 0.1-mm thick cross-linked PTFE sheet ("Excelon XF-1B" manufactured by Hitachi Cable, Ltd.) serving as a fluororesin layer is prepared.

The mesh sheet is stacked over the cross-linked PTFE sheet of the multilayer sheet. In this case, the 400-mm sides of the multilayer sheet are aligned with the 400-mm sides of the mesh sheet, and the 50-mm sides of the mesh sheet are made to overlap the center of the 80-mm sides of the multilayer sheet. Recesses are formed by applying pressure to the die with a pressing device while heating the die to 180° C.

By performing the above-described process, a sheet-shaped (80 mm by 400 mm) slide member having a (50 mm by 400 mm) slide surface dotted with cross-shaped recesses in a lattice pattern is obtained.

With regard to the cross-shaped pattern, the line width is irregular ranging between 5 μm and 30 μm, and the line width increases toward the intersection points of the cross-shaped pattern. Moreover, the crosses are partially continuous.

Third Comparative Example

Preparation of Die

An electroformed nickel die having a pressing surface with a (50 mm by 400 mm) region dotted with right-circular-cylindrical protrusions, whose base and upper base have a diameter of 0.2 mm and whose height is 0.1 mm, is fabricated by electro-fine-forming.

The right-circular-cylindrical protrusions are dotted over the aforementioned region such that the center of the base and the upper base of each right-circular cylinder is located on a lattice point of a centered lattice.

Each unit cell of the centered lattice has a size of 0.6 mm by 0.4 mm. Furthermore, the longer sides (i.e., 0.6-mm sides) of each unit cell of the centered lattice are aligned with the 50-mm sides of the aforementioned region.

Formation of Recesses

An (80 mm by 400 mm) multilayer sheet formed by bonding a 75-μm thick polyimide resin sheet serving as a substrate to a 0.1-mm thick cross-linked PTFE sheet ("Excelon XF-1B" manufactured by Hitachi Cable, Ltd.) serving as a fluororesin layer is prepared.

The die is stacked over the cross-linked PTFE sheet of the multilayer sheet. In this case, the 400-mm sides of the multilayer sheet are aligned with the 400-mm sides of the die, and the 50-mm sides of the die are made to overlap the center of the 80-mm sides of the multilayer sheet. Recesses are formed by applying pressure to the die with a pressing device while heating the die to 180° C.

By performing the above-described process, a sheet-shaped (80 mm by 400 mm) slide member having a (50 mm by 400 mm) slide surface dotted with recesses in a centered lattice pattern is obtained.

Each of the recesses has a right-circular-cylindrical shape with a diameter of 0.2 mm and a depth of 0.1 mm, and the percentage at which the total area of the openings of the recesses occupies the slide surface is about 26%.

First Example

Preparation of Die

An electroformed nickel die having a pressing surface with a (50 mm by 400 mm) region dotted with right-circular-cylindrical protrusions, whose base and upper base have a diameter of 0.33 mm and whose height is 0.1 mm, is fabricated by electro-fine-forming.

The right-circular-cylindrical protrusions are dotted over the aforementioned region such that the center of the base and the upper base of each right-circular cylinder is located on a lattice point of a honeycomb array constituted of closest packed regular hexagons.

In the honeycomb array, each regular hexagon has 0.5-mm sides (specifically, the array pitch is √3/2 mm). Furthermore, in the honeycomb array, one of the lines L in FIG. 2 is aligned with the extending direction of the 50-mm sides of the aforementioned region.

Formation of Recesses

An (80 mm by 400 mm) multilayer sheet formed by bonding a 75-μm thick polyimide resin sheet serving as a substrate to a 0.1-mm thick cross-linked PTFE sheet ("Excelon XF-1B" manufactured by Hitachi Cable, Ltd.) serving as a fluororesin layer is prepared.

The die is stacked over the cross-linked PTFE sheet of the multilayer sheet. In this case, the 400-mm sides of the multilayer sheet are aligned with the 400-mm sides of the die, and the 50-mm sides of the die are made to overlap the center of the 80-mm sides of the multilayer sheet. Recesses are formed by applying pressure to the die with a pressing device while heating the die to 180° C.

By performing the above-described process, a sheet-shaped (80 mm by 400 mm) slide member having a (50 mm by 400 mm) slide surface dotted with recesses is obtained.

The recesses each have a right-circular-cylindrical shape with a diameter of 0.33 mm and a depth of 0.1 mm and are arranged in a honeycomb array having regular hexagons (with 0.5-mm sides and arranged at an array pitch of √3/2 mm) as unit cells.

In the honeycomb array, one of the lines L in FIG. 2 is aligned with the sliding direction (i.e., the extending direction of the 50-mm sides).

The percentage at which the total area of the openings of the recesses occupies the slide surface is about 26%.

Second Example

Preparation of Die

An electroformed nickel die having a pressing surface with a (50 mm by 400 mm) region dotted with right-circular-cylindrical protrusions, whose base and upper base have a diameter of 0.25 mm and whose height is 0.1 mm, is fabricated by electro-fine-forming.

The right-circular-cylindrical protrusions are dotted over the aforementioned region such that the center of the base and the upper base of each right-circular cylinder is located on a lattice point of a honeycomb array constituted of closest packed regular hexagons.

In the honeycomb array, each regular hexagon has 0.5-mm sides (specifically, the array pitch is √3/2 mm). Furthermore, in the honeycomb array, one of the lines L in FIG. 2 forms a 15° angle in the counterclockwise direction relative to the extending direction of the 50-mm sides of the aforementioned region.

Formation of Recesses

An (80 mm by 400 mm) multilayer sheet formed by bonding a 75-μm thick polyimide resin sheet serving as a substrate to a 0.1-mm thick cross-linked PTFE sheet ("Excelon XF-1B" manufactured by Hitachi Cable, Ltd.) serving as a fluororesin layer is prepared.

The die is stacked over the cross-linked PTFE sheet of the multilayer sheet. In this case, the 400-mm sides of the multilayer sheet are aligned with the 400-mm sides of the die, and the 50-mm sides of the die are made to overlap the center of the 80-mm sides of the multilayer sheet. Recesses are formed by applying pressure to the die with a pressing device while heating the die to 180° C.

By performing the above-described process, a sheet-shaped (80 mm by 400 mm) slide member having a (50 mm by 400 mm) slide surface dotted with recesses is obtained.

The recesses each have a right-circular-cylindrical shape with a diameter of 0.25 mm and a depth of 0.1 mm and are arranged in a honeycomb array having regular hexagons (with 0.5-mm sides and arranged at an array pitch of √3/2 mm) as unit cells.

In the honeycomb array, one of the lines L in FIG. 2 forms a 15° angle in the clockwise direction relative to the sliding direction (i.e., the extending direction of the 50-mm sides).

The percentage at which the total area of the openings of the recesses occupies the slide surface is about 15%.

Third Example

Preparation of Die

A die that is the same as that in the second example is prepared.

Formation of Recesses

An (80 mm by 400 mm) 0.3-mm thick cross-linked PTFE sheet ("Excelon XF-1B" manufactured by Hitachi Cable, Ltd.) serving as a fluororesin layer is prepared, and the die is stacked over this sheet. In this case, the 400-mm sides of the sheet are aligned with the 400-mm sides of the die, and the 50-mm sides of the die are made to overlap the center of the 80-mm sides of the sheet. Recesses are formed by applying pressure to the die with a pressing device while heating the die to 180° C.

By performing the above-described process, a sheet-shaped (80 mm by 400 mm) slide member having a (50 mm by 400 mm) slide surface dotted with recesses is obtained.

The recesses each have a right-circular-cylindrical shape with a diameter of 0.25 mm and a depth of 0.1 mm and are arranged in a honeycomb array having regular hexagons (with a distance of 0.5 mm between lattice points and arranged at an array pitch of √3/2 mm) as unit cells.

In the honeycomb array, one of the lines L in FIG. 2 forms a 15° angle in the clockwise direction relative to the sliding direction (i.e., the extending direction of the 50-mm sides).

The percentage at which the total area of the openings of the recesses occupies the slide surface is about 15%.

Fourth Example

Preparation of Die

An electroformed nickel die having a pressing surface with a (50 mm by 400 mm) region dotted with right-circular-cylindrical protrusions, whose base and upper base have a diameter of 0.2 mm and whose height is 0.1 mm, is fabricated by electro-fine-forming.

The right-circular-cylindrical protrusions are dotted over the aforementioned region such that the center of the base and the upper base of each right-circular cylinder is located on a lattice point of a honeycomb array constituted of closest packed regular hexagons.

In the honeycomb array, each regular hexagon has 0.4-mm sides (specifically, the array pitch is 2√3/5 mm). Furthermore, in the honeycomb array, one of the lines L in FIG. 2 forms a 15° angle in the counterclockwise direction relative to the extending direction of the 50-mm sides of the aforementioned region.

Formation of Recesses

An (80 mm by 400 mm) multilayer sheet formed by bonding a 75-μm thick polyimide resin sheet serving as a substrate to a 0.1-mm thick cross-linked PTFE sheet ("Excelon XF-1B" manufactured by Hitachi Cable, Ltd.) serving as a fluororesin layer is prepared.

The die is stacked over the cross-linked PTFE sheet of the multilayer sheet. In this case, the 400-mm sides of the multilayer sheet are aligned with the 400-mm sides of the die, and the 50-mm sides of the die are made to overlap the center of the 80-mm sides of the multilayer sheet. Recesses are formed by applying pressure to the die with a pressing device while heating the die to 180° C.

By performing the above-described process, a sheet-shaped (80 mm by 400 mm) slide member having a (50 mm by 400 mm) slide surface dotted with recesses is obtained.

The recesses each have a right-circular-cylindrical shape with a diameter of 0.2 mm and a depth of 0.1 mm and are arranged in a honeycomb array having regular hexagons (with a distance of 0.4 mm between lattice points and arranged at an array pitch of $2\sqrt{3}/5$ mm) as unit cells.

In the honeycomb array, one of the lines L in FIG. 2 forms a 15° angle in the clockwise direction relative to the sliding direction (i.e., the extending direction of the 50-mm sides).

The percentage at which the total area of the openings of the recesses occupies the slide surface is about 15%.

Evaluations

As an evaluation apparatus, "Color 1000 Press" manufactured by Fuji Xerox Co., Ltd. and equipped with a belt-roll-nip-type fixing device is prepared.

The fixing device in this evaluation apparatus has a configuration similar to that of the fixing device 80 shown in FIG. 5 and has a heating belt (corresponding to the heating belt 84 in FIG. 5) whose inner peripheral surface has a surface roughness Ra of 0.6 μm.

The slide member according to each of the examples and the comparative examples described above is attached to the fixing device in the evaluation apparatus and is operated continuously at a processing speed of 800 mm/s in a 22° C./55RH % environment.

Abrasion Amount of Slide Member

After 500,000 sheets (500 kpv) have passed, the slide member is removed from the fixing device, and the thickness of the slide member is measured by using an eddy-current thickness measuring device (manufactured by Fischer Instruments K. K.).

The measurement is performed on five arbitrary points on the flat portion of the (50 mm by 400 mm) slide surface. A difference (μm) between an average value of these five points and a premeasured thickness of the slide member before use is determined as an amount of abrasion. The results obtained are shown in Table 1.

In the first comparative example, the PTFE layer is abraded, leaving the glass cloth exposed.

Friction Coefficient of Slide Member

A friction coefficient (i.e., initial friction coefficient) between the slide member and the heating belt as the opposed slide member at the start of operation and a friction coefficient after a predetermined number of sheets have passed are measured based on the following method.

For the measurement, a system friction coefficient is determined as a substitute for the friction coefficient by measuring a system torque by using a torque motor that can be constantly monitored. Then, evaluations are performed in accordance with the following evaluation criteria. The results obtained are shown in Table 1.

Evaluation Criteria for Friction Coefficients

A: The initial friction coefficient is 1.0 or lower, and the friction coefficient after 3,000,000 sheets (3 Mpv) have passed is 1.2 or lower.

B: The initial friction coefficient is 1.0 or lower, and the friction coefficient after 1,000,000 sheets (1 Mpv) have passed is 1.5 or lower.

C: The initial friction coefficient is 1.0 or lower, and the friction coefficient after 400,000 sheets (400 kpv) have passed is 1.5 or lower.

D: The initial friction coefficient is 1.0 or lower, and the friction coefficient after 400,000 sheets (400 kpv) have passed is higher than 1.5.

TABLE 1

| | Diameter of Openings of Recesses | Length of Each Side of Regular Hexagons of Honeycomb Array | Inclination of Honeycomb Array | Percentage at which Total Area of Openings of Recesses Occupies Slide Surface | Abrasion Amount | Initial Friction Coefficient | Evaluation Result for Friction Coefficient |
|---|---|---|---|---|---|---|---|
| First Comparative Example | — | — | — | — | Non-Evaluable | 0.07 | D |
| Second Comparative Example | — | — | — | — | 20 μm | 0.11 | D |
| Third Comparative Example | 0.2 mm | — | — | 26% | 8 μm | 0.09 | C |
| First Example | 0.33 mm | 0.5 mm | 0° | 26% | 6 μm | 0.08 | B |
| Second Example | 0.25 mm | 0.5 mm | 15° | 15% | 4 μm | 0.08 | A |
| Third Example | 0.25 mm | 0.5 mm | 15° | 15% | 4 μm | 0.08 | A |
| Fourth Example | 0.2 mm | 0.4 mm | 15° | 15% | 4 μm | 0.08 | A |

It is obvious from Table 1 that the first to fourth examples may achieve a smaller amount of abrasion after passing of sheets, as compared with the first to third comparative examples in which the initial friction coefficients are substantially the same, thereby achieving high abrasion resistance of the slide surface. Furthermore, in the first to fourth examples, an increase in friction coefficient caused by repeating the fixing process may be suppressed, as compared with the first to third comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A slide member for a fixing device, the slide member comprising:

a fluororesin layer having a slide surface dotted with recesses, wherein the recesses in the slide surface are arranged in an array having parallel hexagons as unit cells, wherein the array having parallel hexagons as the unit cells is an array having regular hexagons as the unit cells, and wherein when a line connecting central points of two arbitrary adjacent regular hexagons is drawn, an angle formed between the line and a sliding direction is not equal to 0°, 30°, 60°, 90°, 120°, or 150°.

2. The slide member according to claim 1, wherein each of lines constituting a width of the slide surface is provided with at least one of the recesses.

3. The slide member according to claim 1, wherein a period of the array having the parallel hexagons as the unit cells ranges between 0.2 mm and 2.0 mm, and an area of an opening of each recess ranges between $7\times10^{-3}$ $mm^2$ and 3.2 $mm^2$.

4. The slide member according to claim 1, wherein a percentage at which a total area of openings of the recesses occupies the slide surface ranges between 10% and 60%.

5. A fixing device comprising:

a first rotating body;

a second rotating body disposed in contact with an outer surface of the first rotating body;

a pressing member that is disposed within the second rotating body and presses the second rotating body toward the first rotating body from an inner surface of the second rotating body; and the slid member according to claim 1, the slide member being disposed between the inner surface of the second rotating body and the pressing member.

6. The fixing device according to claim 5, wherein the inner surface of the second rotating body has a surface roughness Ra ranging between 0.1 μm and 2.0 μm.

7. An image forming apparatus comprising:

an image bearing body;

a charging device that electrostatically charges a surface of the image bearing body;

a latent-image forming device that forms a latent image on the electrostatically-charged surface of the image bearing body;

a developing device that forms a toner image by developing the latent image by using toner;

a transfer device that transfers the toner image onto a recording medium; and the fixing device according to claim 6, the fixing device fixing the toner image onto the recording medium.

* * * * *